US011871878B1

(12) United States Patent
Morales

(10) Patent No.: US 11,871,878 B1
(45) Date of Patent: Jan. 16, 2024

(54) AUTOMATIC PAPER TOWEL DISPENSER

(71) Applicant: Yanier Morales, Hialeah, FL (US)

(72) Inventor: Yanier Morales, Hialeah, FL (US)

( * ) Notice: Subject to any disclaimer, the term of this patent is extended or adjusted under 35 U.S.C. 154(b) by 0 days.

(21) Appl. No.: 18/491,364

(22) Filed: Oct. 20, 2023

(51) Int. Cl.
*A47K 10/38* (2006.01)
*A47K 10/32* (2006.01)

(52) U.S. Cl.
CPC .. *A47K 10/3836* (2013.01); *A47K 2010/3233* (2013.01)

(58) Field of Classification Search
CPC ..... A47K 10/38; A47K 2010/3233; A47K 10/3836; B65H 16/04; B65H 18/026
See application file for complete search history.

(56) References Cited

U.S. PATENT DOCUMENTS 6,098,917 A * 8/2000 Cruz ..... A47K 10/3836 242/590
6,161,796 A * 12/2000 Daniels ..... A47K 10/3836 242/598.5
2014/0131506 A1* 5/2014 Clarkin ..... A47K 3/281 242/598.6
2014/0367507 A1* 12/2014 Trampolski ..... A47K 10/3836 242/560.1
2015/0342423 A1* 12/2015 Kling ..... A47K 10/3625 242/564
2017/0265692 A1* 9/2017 Deng ..... A47K 10/3836
2018/0160863 A1* 6/2018 Xu ..... A47K 5/00

* cited by examiner

*Primary Examiner* — William A. Rivera
(74) *Attorney, Agent, or Firm* — Ruben Alcoba, Esq.

(57) ABSTRACT

A vertical paper towel dispenser that comprises a housing that has a moveable front wall. The moveable front wall is mounted on a plate that moves inward and outward from the housing. The plate is moved using a pulley system that that is connected to a first motor that is controlled by a controller. The plate is mounted on a plate holder that is secured to a pulley of the pulley system. The plate has a front vertical tension roller that is positioned at a front corner of the plate, and a central post that is positioned at a central position of the plate. A second motor is attached to the base of the housing at a position that is at a front corner of the base and a roller is mounted on the second motor. The second motor is controlled by the controller. A rechargeable battery powers the dispenser.

10 Claims, 5 Drawing Sheets

AUTOMATIC PAPER TOWEL DISPENSER

BACKGROUND

The present invention is directed to an automatic paper towel dispenser that vertically dispenses paper towels.

The present invention is designed to be placed on flat surfaces.

The paper towel dispenser of the present invention houses a roll of paper towels within a structure that is designed to feed the paper towels to a user from a vertical position.

The present invention is designed to be easily loadable, for it has a tray that extends outward from the housing of the paper towel dispenser when loading the roll of paper towels into the paper towel dispenser.

The present invention is designed to prevent paper towels that are loaded within the paper towel dispenser from being contaminated from the outer environment that surrounds the paper towel dispenser.

The paper towel dispenser does not require a fixed anchor to be functional.

For the foregoing reason, there is a need for an automatic paper towel dispenser that vertically dispenses a paper towel to a user.

SUMMARY

The present invention is an automatic paper towel dispenser that vertically dispenses paper towels.

The vertical paper house dispenser comprised a housing that has a moveable front wall. The moveable front wall is mounted on a plate that moves inward and outward from the housing. The plate is moved using a pulley system that that is connected to a first motor that is controlled by a controller. The pulley system and the first motor are attached to the base of the housing. The plate is mounted on a plate holder that is secured to a pulley of the pulley system. The plate has a front vertical tension roller that is positioned at a front corner of the plate, and a central post that is positioned at a central position of the plate. A second motor is attached to the base of the housing at a position that is at a front corner of the base and a roller is mounted on the second motor, the motor is a reversible motor that controls the clockwise and counterclockwise spin of the roller, the second motor is controlled by the controller, and the roller and the front vertical tension roller are configured to work together when the moveable front wall is closed on the housing. A rechargeable battery is connected to the controller and serves to power the controller, the first motor and the second motor.

In preferred embodiments, the housing will be made of four supports that will be placed on all of the corners of the base of the housing, a top support structure that will be secured on the four supports, three vertical walls that will be secured to the four supports so that an open side is left open on the housing, and a top cover that is secured to the top structure.

An object of the present invention is to provide a vertical towel dispenser that has a moveable front wall that allows a vertical towel to be loaded onto a central post of the system.

Another object of the present invention is to provide a vertical towel dispenser that does not require an anchor to be functional.

Yet another object of the present invention is to provide a vertical towel dispenser that automatically dispenses paper towels.

Yet another object of the present invention is to provide a vertical paper towel dispenser that will prevent paper towels from being contaminated from the environment that surrounds the vertical paper towel dispenser.

BRIEF DESCRIPTION OF THE DRAWINGS

These and other features, aspects, and advantages of the present invention will become better understood with regards to the following description, appended claims, and drawings where:

and

Figure 1:
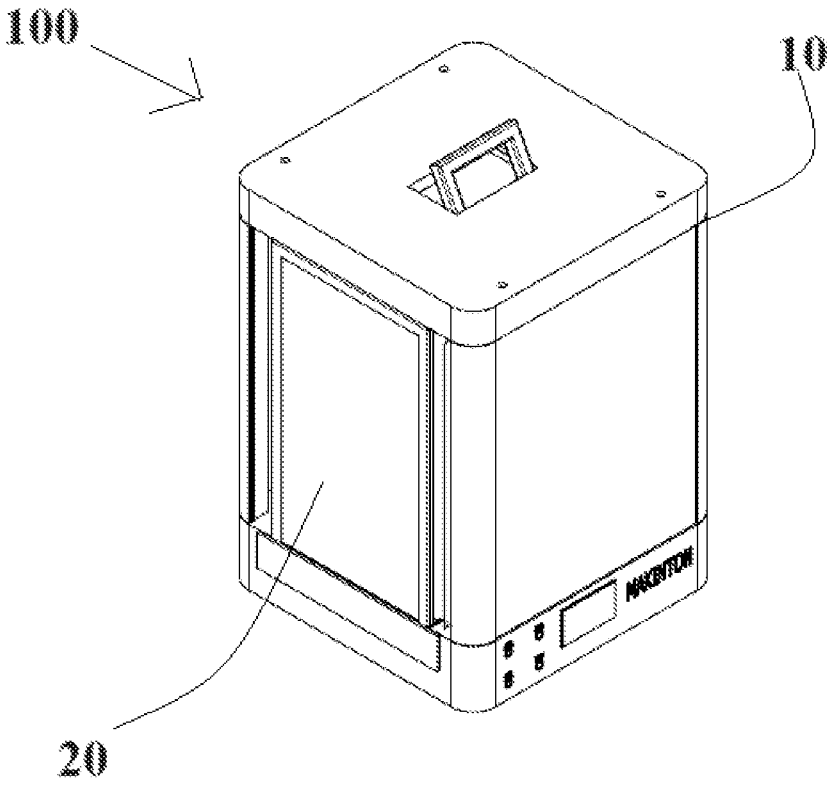
FIG. 1 is a perspective view of the present invention in a closed position.
Figure 2:
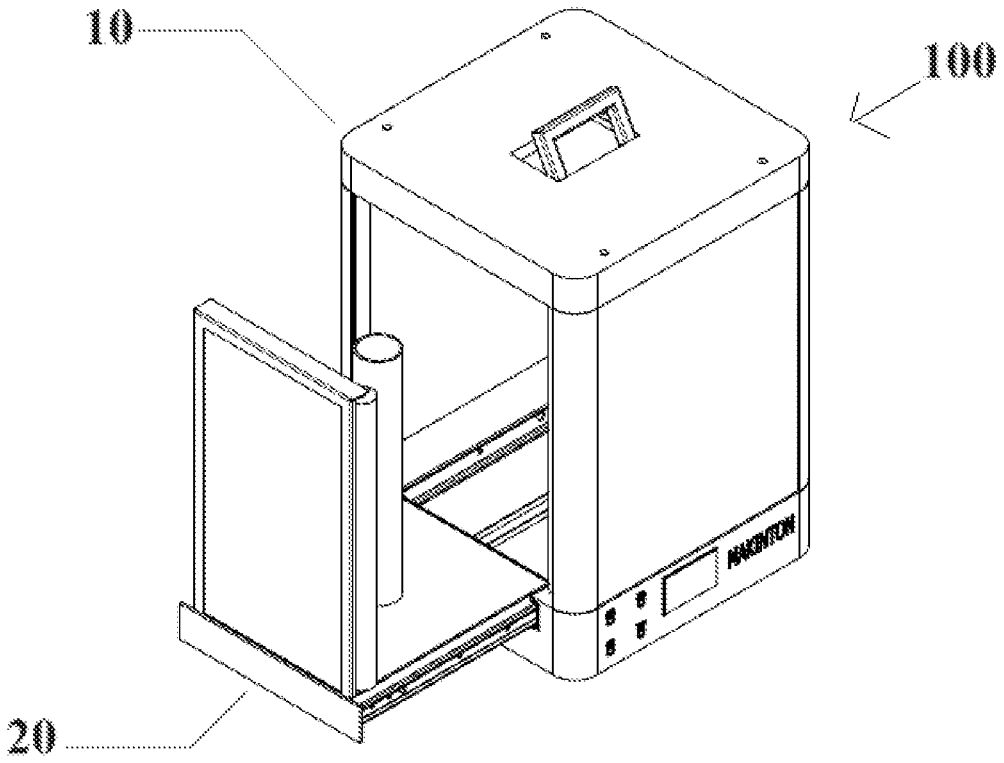
FIG. 2 is a perspective view of the present invention is an open position.
Figure 3:
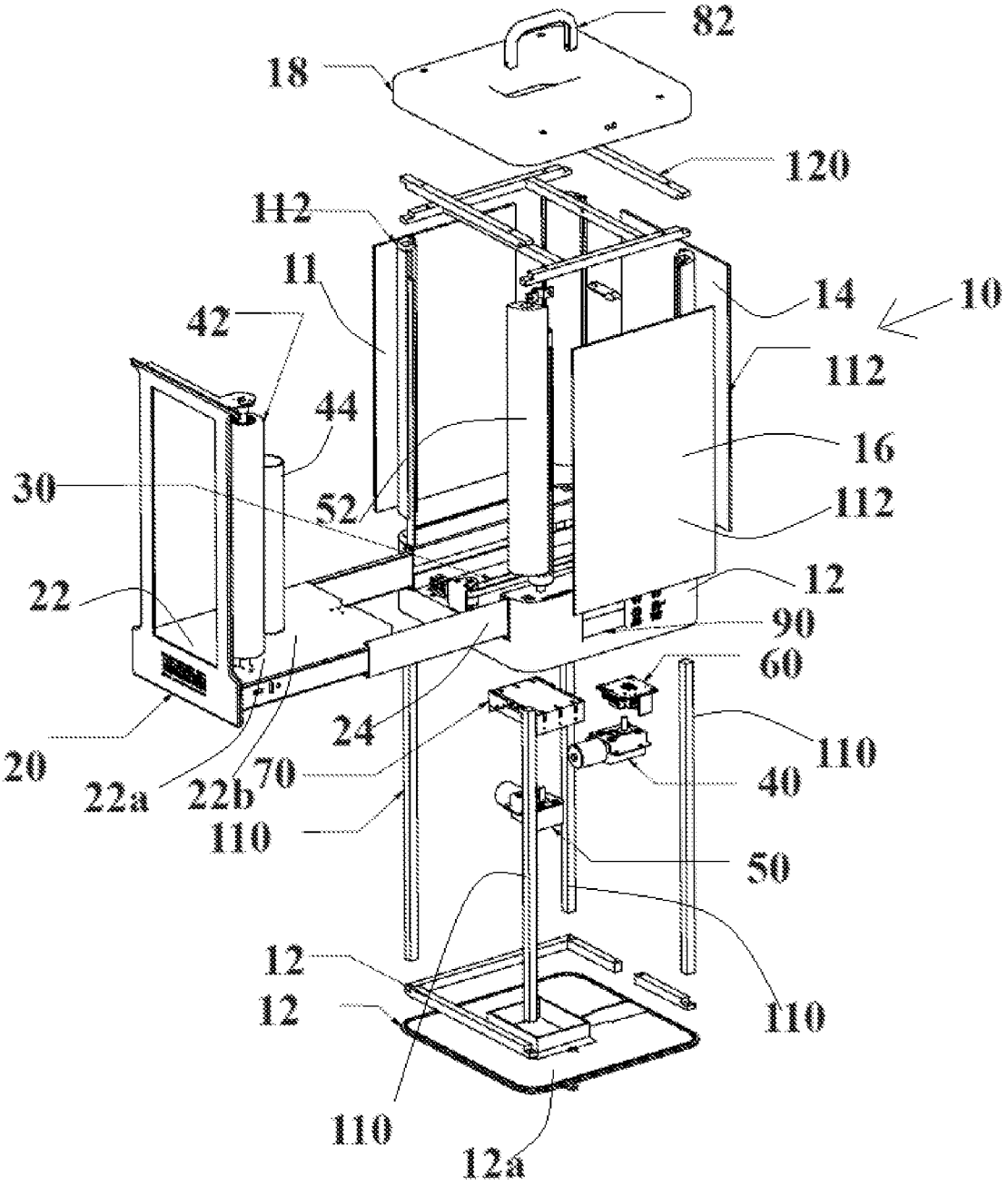
FIG. 3 is a perspective exploded view of the present invention.
Figure 4:
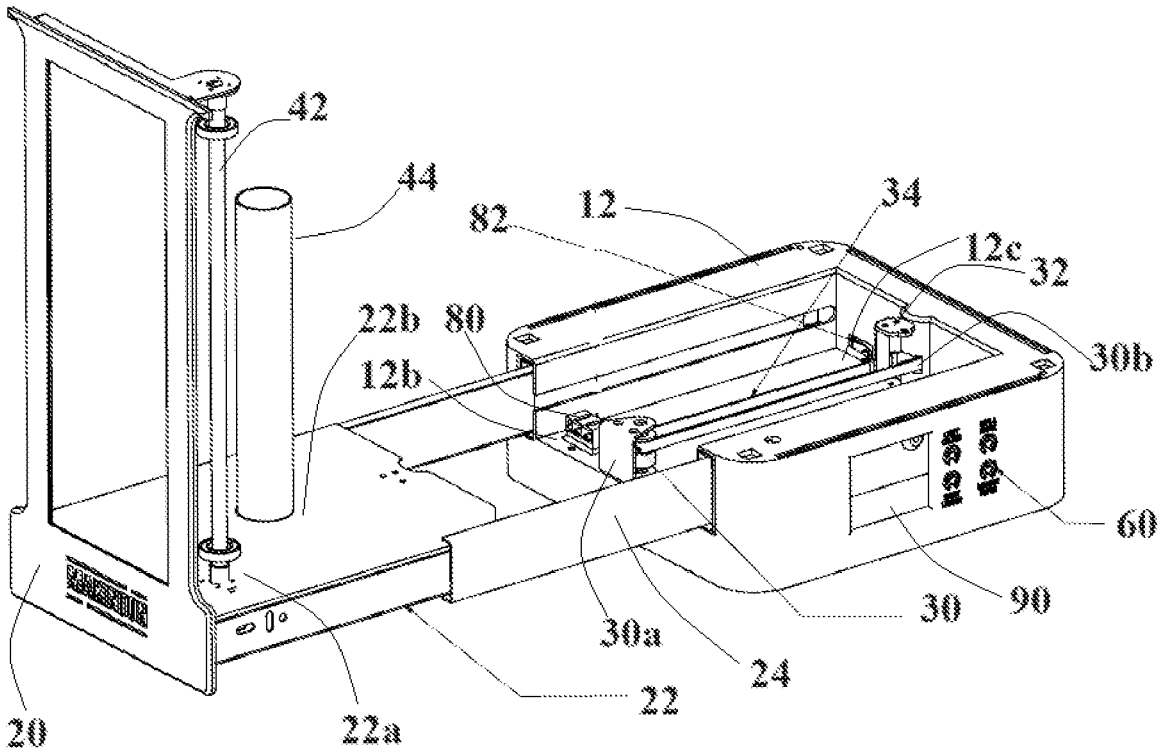
FIG. 4 is a perspective view of the pulley system and the front wall of the present invention.
Figure 5:
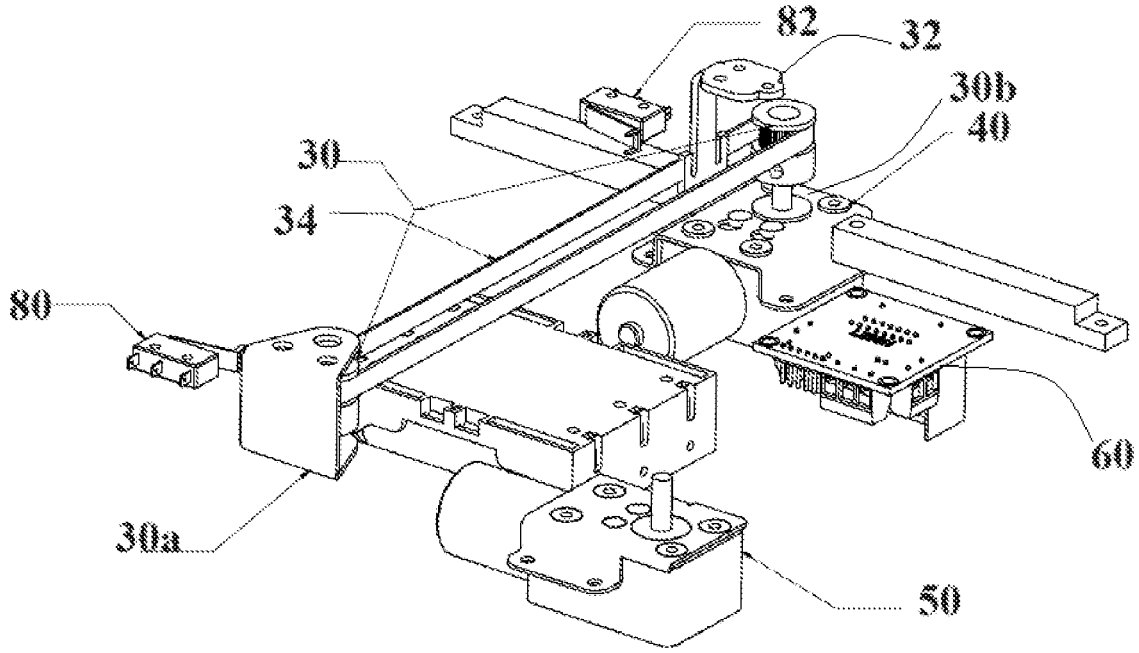

FIG. 5 is a perspective view that shows the operational parts of the present invention.

DESCRIPTION

As seen in FIGS. 1-5, an automatic paper towel dispenser 100 that vertically dispenses paper towels.

The automatic paper towel dispenser 100 comprises of a housing 10 that has a base 12, a left wall 12, a rear wall 14, and a right wall 16, and a top cover 18. A moveable front wall 20 that is mounted on a plate 22 that moves inward and outward from the housing 10, the plate 22 is mounted on a track guide 24 that is attached to the base 12. A pulley system 30 is attached to the plate 22 and to the base 12. A first motor 40 is attached to the pulley system 30, the first motor 40 is attached to the base 12. A plate holder 32 is secured on a pulley 34 of the pulley system 30, the plate holder 32 is attached to the plate 22. A front vertical tension roller 42 is attached to a front corner 22*a* of the plate 22. A central post 44 is attached to a central position 22*b* of the plate 22. A second motor 50 is attached to the base 12 at a position that is at a front corner 12*a* of the base 12 and a roller 52 is mounted on the second motor 50, the second motor 50 is a reversible motor that controls the clockwise and counterclockwise spin of the roller 52, the roller 52 and the front vertical tension roller 42 are configured work together when the moveable front wall 20 is closed on the housing 10. A controller 60 is mounted on the base 12, the controller 60 is operatively connected to the first motor 40 and to the second motor 50. And, a rechargeable battery 70 that connects to the controller 60, the rechargeable battery 70 serves to power the controller 60, the first motor 40, and the second motor 50.

In an embodiment of the present invention, the automatic paper towel dispenser 100 comprises of a first sensor 80 that is attached to a front position 12*b* of the base 12 and second sensor 82 that is attached to a rear position 12*c* of the base 12, the first sensor 80 is aligned to a front position 30*a* of the pulley system 30 and the second sensor 82 is aligned to rear position 30*b* of the pulley system 30.

In another embodiment of the present invention, the automatic paper towel dispenser 100 has a display 90 that is attached to the controller 60.

In still another embodiment of the present invention, all of the walls of the housing 10 are made of an acrylic material.

In yet still another embodiment of the present invention, the automatic paper towel dispenser comprises a handle 82 that is attached to the top cover 18.

In a further embodiment of the present invention, the housing 10 comprises four supports 110 that are placed on all of the corners of the base 12, a top support structure 120 that is attached to the four supports 110, and three vertical walls 112 are attached the four supports 110 so that an open side 114 is left open on the housing 10, the top cover 18 is attached to the top support structure 120.

An advantage of the present invention is that it provides a vertical towel dispenser that has a moveable front wall that allows a vertical towel to be loaded onto a central post of the system.

Another advantage of the present invention is that it provides a vertical towel dispenser that does not require an anchor to be functional.

Yet another advantage of the present invention is that is provides a vertical towel dispenser that automatically dispenses paper towels.

While the inventor's description contains many specificities, these should not be construed as limitations on the scope, but rather as an exemplification of several preferred embodiments thereof. Accordingly, the scope should not be determined by the embodiments illustrated, but by the appended claims and their legal equivalents.

What is claimed is:

1. An automatic paper towel dispenser that vertically dispenses paper towels, the automatic paper towel dispenser comprises:

a housing that has a base, a left wall, a rear wall, and a right wall, and a top cover;

a moveable front wall that is mounted on a plate that moves inward and outward from the housing, the plate is mounted on a track guide that is attached to the base;

a pulley system is attached to the plate and to the base;

a first motor is attached to the pulley system, the first motor is attached to the base;

a plate holder is secured on a pulley of the pulley system, the plate holder is attached to the plate;

a front vertical tension roller is attached to a front corner of the plate;

a central post is attached to a central position of the plate;

a second motor is attached to the base at a position that is at a front corner of the base and a roller is mounted on the second motor, the second motor is a reversible motor that controls the clockwise and counterclockwise spin of the roller, the roller and the front vertical tension roller are configured work together when the moveable front wall is closed on the housing;

a controller is mounted on the base, the controller is operatively connected to the first motor and to the second motor; and a rechargeable battery is connected to the controller, the rechargeable battery serves to power the controller, the first motor, and the second motor.

2. The automatic paper towel dispenser that vertically dispenses paper towels of claim 1, the automatic paper towel dispenser comprises of a first sensor that is attached to a front position of the base and second sensor that is attached to a rear position of the base, the first sensor is aligned to a front position of the pulley system and the second sensor is aligned to rear position of the pulley system.

3. The automatic paper towel dispenser that vertically dispenses paper towels of claim 2, the automatic paper towel dispenser comprises a display that is attached to the controller.

4. The automatic paper towel dispenser that vertically dispenses paper towels of claim 3, wherein all of the walls of the housing are made of an acrylic material.

5. The automatic paper towel dispenser that vertically dispenses paper towels of claim 4, wherein the automatic paper towel dispenser comprises a handle that is attached to the top cover.

6. An automatic paper towel dispenser that vertically dispenses paper towels of claim 1, wherein the housing comprises four supports that are placed on all of the corners of the base, a top support structure that is attached to the four supports, and three vertical walls are attached the four supports so that an open side is left open on the housing, the top cover is attached to the top support structure.

7. The automatic paper towel dispenser that vertically dispenses paper towels of claim 6, the automatic paper towel dispenser comprises of a first sensor that is attached to a front position of the base and second sensor that is attached to a rear position of the base, the first sensor is aligned to a front position of the pulley system and the second sensor is aligned to rear position of the pulley system.

8. The automatic paper towel dispenser that vertically dispenses paper towels of claim 7, the automatic paper towel dispenser comprises a display that is attached to the controller.

9. The automatic paper towel dispenser that vertically dispenses paper towels of claim 8, wherein all of the walls of the housing are made of an acrylic material.

10. The automatic paper towel dispenser that vertically dispenses paper towels of claim 9, wherein the automatic paper towel dispenser comprises a handle that is attached to the top cover.

* * * * *